United States Patent [19]

Richards

[11] Patent Number: 4,613,739

[45] Date of Patent: Sep. 23, 1986

[54] MICROCOMPUTER CONTROL FOR MICROWAVE OVEN

[75] Inventor: Paul L. Richards, St. Joseph Township, Berrien County, Mich.

[73] Assignee: Whirlpool Corporation, Benton Harbor, Mich.

[21] Appl. No.: 516,592

[22] Filed: Jul. 25, 1983

[51] Int. Cl.[4] ..... H05B 6/64

[52] U.S. Cl. ..... 219/10.55 B; 219/506; 364/400; 364/420; 364/421; 340/365 R

[58] Field of Search ..... 219/10.55 B, 506, 492; 364/900, 420, 421, 705, 709, 365 R, 143-146, 477

[56] References Cited

U.S. PATENT DOCUMENTS

| | | | |
|---|---|---|---|
| 3,470,942 | 10/1969 | Fukada et al. | 165/2 |
| 4,011,428 | 3/1977 | Fosnough et al. | 219/10.55 B |
| 4,104,542 | 8/1978 | Karklys et al. | 307/141 |
| 4,223,379 | 9/1980 | Simcoe | 364/400 X |
| 4,245,296 | 1/1981 | Small et al. | 364/104 |
| 4,250,370 | 2/1981 | Sasaki et al. | 219/10.55 B |
| 4,255,639 | 3/1981 | Kawabata et al. | 219/10.55 B |
| 4,295,027 | 10/1981 | Zushi et al. | 219/10.55 B |
| 4,343,977 | 8/1982 | Koyama | 219/10.55 B |
| 4,390,766 | 6/1983 | Horinouchi | 219/10.55 B |
| 4,394,643 | 7/1983 | Williams | 340/365 R |

OTHER PUBLICATIONS

Amana Touchmatic II Radarange Microwave Oven Use and Care Manual for Model RR-1000, Copyright 1982.

*Primary Examiner*—Clarence L. Albritton
*Assistant Examiner*—M. M. Lateef
*Attorney, Agent, or Firm*—Wood, Dalton, Phillips, Mason & Rowe

[57] ABSTRACT

A microwave oven control utilizing a microcomputer. The control permits changing or adding to previously inputted parameters without requiring the cancellation of the entire program and without affecting the progression of other cycles of the program. In the illustrated embodiment, the control provides for facilitated initial input and changing of parameters, such as time, temperature, power; and the like, relative to different commands or functions inputted by suitable touch pads provided in a control panel for actuation by the user.

8 Claims, 3 Drawing Figures

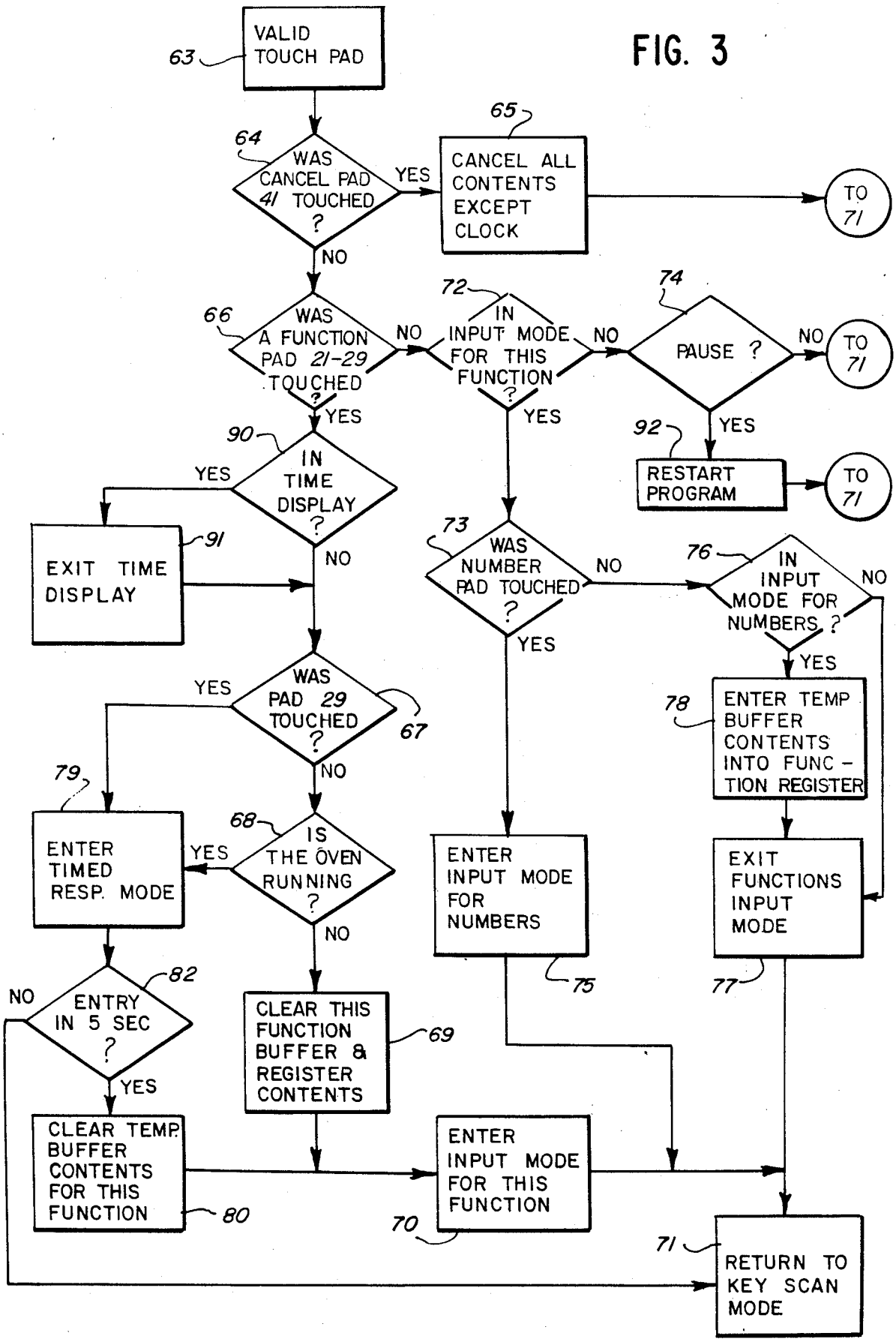
FIG. 3
63
VALID TOUCH PAD
64
WAS CANCEL PAD 41 TOUCHED ?
YES
NO
65
CANCEL ALL CONTENTS EXCEPT CLOCK
TO 71
66
WAS A FUNCTION PAD 21-29 TOUCHED ?
NO
YES
72
IN INPUT MODE FOR THIS FUNCTION ?
NO
YES
74
PAUSE ?
NO
TO 71
YES
92
RESTART PROGRAM
TO 71
90
IN TIME DISPLAY ?
YES
NO
91
EXIT TIME DISPLAY
73
WAS NUMBER PAD TOUCHED ?
NO
YES
76
IN INPUT MODE FOR NUMBERS ?
NO
YES
78
ENTER TEMP BUFFER CONTENTS INTO FUNC - TION REGISTER
WAS PAD 29 TOUCHED ?
YES
NO
67
79
ENTER TIMED RESP. MODE
68
IS THE OVEN RUNNING ?
YES
NO
ENTER INPUT MODE FOR NUMBERS
75
EXIT FUNCTIONS INPUT MODE
77
82
ENTRY IN 5 SEC ?
NO
YES
CLEAR THIS FUNCTION BUFFER & REGISTER CONTENTS
69
CLEAR TEMP. BUFFER CONTENTS FOR THIS FUNCTION
80
ENTER INPUT MODE FOR THIS FUNCTION
70
71
RETURN TO KEY SCAN MODE

MICROCOMPUTER CONTROL FOR MICROWAVE OVEN

BACKGROUND OF THE INVENTION

. Field of the Invention

This invention relates to microwave ovens and in particular to control means for use in controlling the operation of such ovens.

2. Description of the Background Art

In one conventional form of microwave oven, a touch pad input control is provided for selective use by the user in obtaining different cycles of operation of the oven. Conventionally, the control permits selection of different heating cycles, with digital input means for varying the parameters of the different cycles, including both time and temperature parameters.

It has been found desirable to permit the user to change the selected parameters at any time during operation of the oven without affecting the continued operation thereof to complete the initiated program.

Illustrations of prior art microwave oven controls are found in U.S. Pat. Nos. 3,470,942 of Shuzo Fukada et al.; 4,011,428 of Robert Fosnough et al.; 4,104,542 of Joseph Karklys et al., which patent is owned by the assignee hereof; 4,245,296 of James E. Small et al.; 4,250,370 of Masayuki Sasaki et al.; 4,343,977 of Hideaki Koyama; and 4,255,639 of Tsuneo Kawabata et al. Each of these patents is concerned with control means such as for use in microwave ovens wherein different cycles of operation may be established having different preselected parameters. None, however, shows or suggests the improved microwave oven control means herein which permits changing, at any time during a cycle of operation, inputted parameters without requiring resetting of the entire program.

SUMMARY OF THE INVENTION

The present invention comprehends an improved microwave oven control means for providing selectively different programs of operation of a microwave oven heating means and selectively different parameters therein. The control means includes means for resetting selected parameters in a previously initiated selected program of operation during continued running thereof.

More specifically, the invention comprehends the provision of such a control means which includes selectively operable first input elements for providing selection of different control functions and second input elements for providing selection of different values of an operation parameter associated therewith.

In the illustrated embodiment, the selectable parameters include time, cook power, and temperature parameters.

The invention comprehends the provision of means in the control for effecting concurrent cancellation of all parameters previously set therein.

The control may further include means for selectively adding to, cancelling, or changing the entire selected program during running thereof.

In the illustrated embodiment, at least one of the cycles requires no input of parameters, and illustratively, comprises a "Keep Warm" cycle.

In the illustrated embodiment, the control means includes a manually operable touch pad input means for use in selecting the cycles and parameters.

The improved microwave oven control of the present invention is extremely simple and economical of construction while yet providing a highly improved, facilitated control of operation of the microwave oven, permitting the desired changing or adding of parameters of different cycles in a program of operation thereof during the continuation of the program.

BRIEF DESCRIPTION OF THE DRAWING

Other features and advantages of the invention will be apparent from the following description taken in connection with the accompanying drawing wherein:

FIG. 3 is a block flow diagram of the microcomputer of the control.

DESCRIPTION OF THE PREFERRED EMBODIMENT

Figure 1:
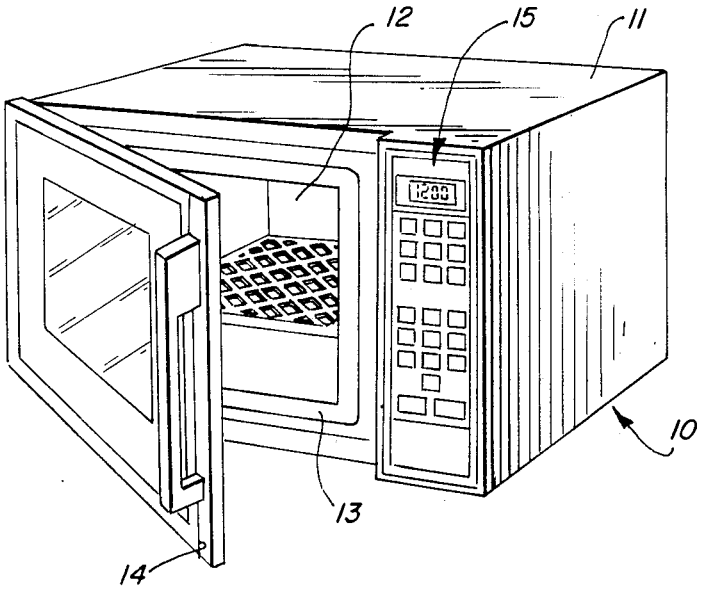
FIG. 1 is a perspective view of a microwave oven having an improved control embodying the invention.

In the exemplary embodiment of the invention as disclosed in FIG. 1, a microwave oven generally designated 10 is shown to comprise an outer housing, or cabinet, 11 defining an oven cavity 12 defining a front opening 13 selectively closed by a door 14. Control of the operation of the oven is effected by user input to a control 15 preferably mounted on the front wall of the cabinet adjacent opening 13, as shown in FIG. 1.

Figure 2:
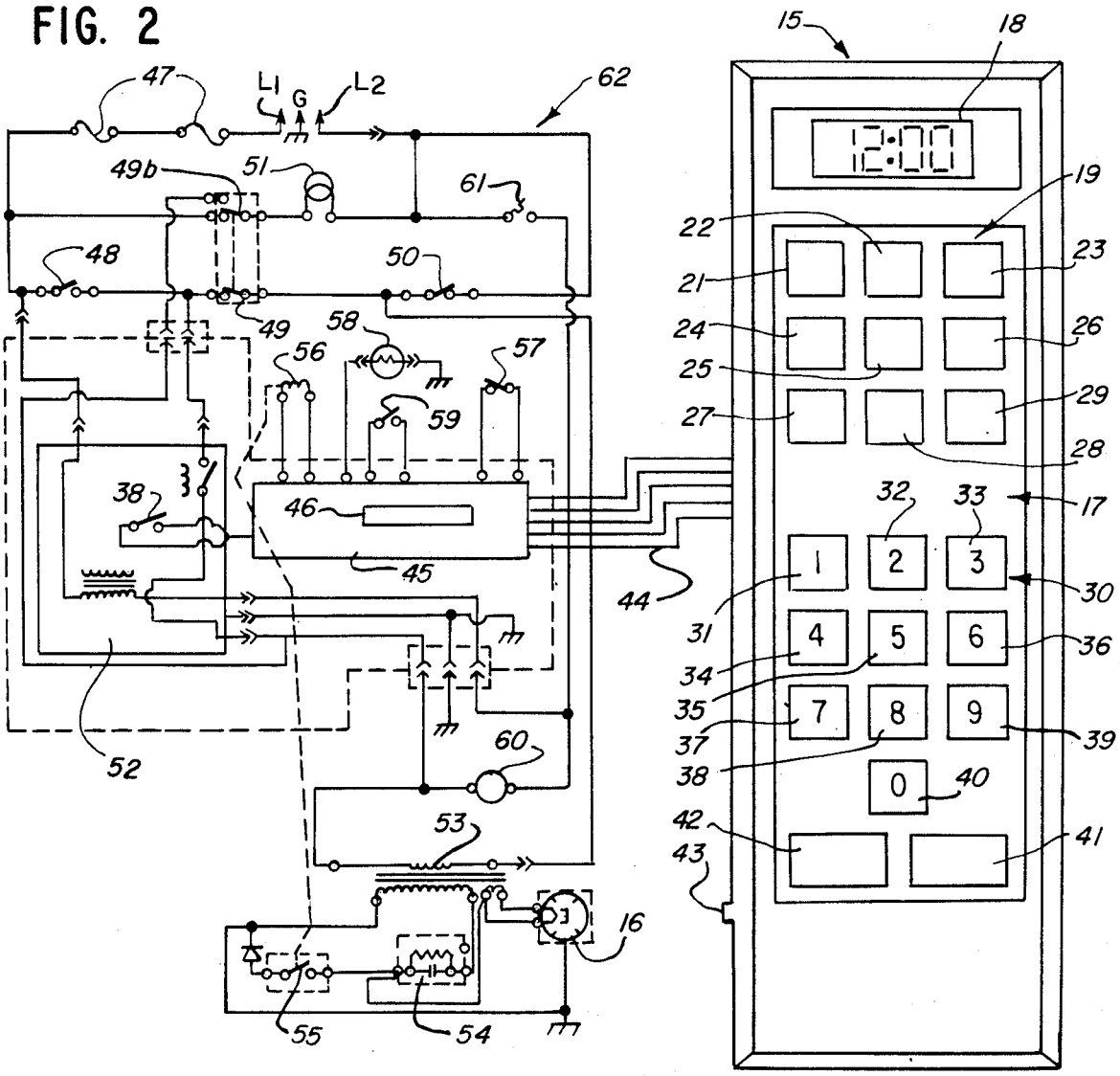
FIG. 2 is a schematic wiring diagram of the control.

Microwave energy is delivered to the oven cavity 12 from a suitable microwave energy generator, such as magnetron 16, as shown in the schematic wiring diagram of FIG. 2. Control 15 is illustrated in greater detail therein as including a control panel 17 provided with a digital display means 18 above a group 19 of function input pads 21–29. A second group 30 of pads is disposed below group 19 and includes number and temperature input pads 31–40. Two additional pads are disposed below group 30, including a cancel pad 41 and a start pad 42. A logic on/off switch button 43 is also provided on the side of panel 17.

Control 15 is connected through a multiconductor cable 44 to a control circuit 62 including a microcomputer assembly board 45 provided with a microcomputer 46. The microcomputer is conventional having the usual functions, registers and buffers, and as utilized with this invention includes temporary buffers **46*a* and function registers 46*b*, one of each associated with each function pad 21–29**. The temporary buffers store information awaiting transfer to the associated function register which is operated on by the microcomputer such as decrementing a time variable from the set value to zero.

The control circuit 62 is energized from a suitable power supply through power supply leads L1, L2 and ground G. Lead L1 may be provided with suitable fuses 47. Conventional control switches are provided for preventing operation of the microwave oven when the door 14 is moved from the closed position across the opening 13, and as shown in FIG. 2, include a primary interlock switch 48, a monitor switch 49, having contacts **49*a*, and a secondary interlock switch 50. A lamp 51 is connected in series with a second set of contacts 49*b* of switch 49 for illuminating the oven cavity 12** when the door is moved to the open position.

A conventional DC power supply 52 is provided for converting the AC 120-volt input current from leads L1 and L2 to the desired DC control voltage. A power transformer 53 is connected to the AC power supply for providing power to the magnetron 16 and includes a capacitor 54 connected in series with a conventional read relay 55 for cycling the magnetron on and off at high frequency. As shown, the read relay is cycled by a coil 56 under the control of the microcomputer 46.

Door switch 57 is closed when the door 14 is in the open position across opening 13 to provide a signal to the microcomputer 46 indicating this condition. A conventional temperature probe adapted to be inserted into the food being cooked comprises a probe 58 and a switch 59 associated therewith connected to the microcomputer to indicate to the microcomputer the insertion of the probe for temperature determination.

Magnetron 16 is force cooled by a suitable fan (not shown) driven by a motor 60 connected through a thermal overload protector 61 to power supply lead L2. The fan further, as is conventional, provides cooling air through the oven cavity concurrently with the cooling of the magnetron microwave energy generator.

Oven 10 is user-controlled by touch actuation of the different function and number of pads 19 and 31 of control panel 17. The panel 17 is constructed in accordance with the teachings of allowed U.S. patent application Ser. No. 258,589 of R. Williams, filed Apr. 29, 1981 entitled "Capacitive Touch Panel Control" and incorporated herein by reference. In normal operation, the user touches the desired function and number pads in a suitable sequence to program the microcomputer 46 to carry out desired different cycles of operation of the oven. Illustratively, two separate cook cycles are provided by the function pads 21 and 22, permitting cooking operations within oven cavity 12 by energization of the microwave energy generator 16 for up to 99 minutes and 99 seconds each. These cook cycles are programmed by the user touching the appropriate cook cycle pad and then the appropriate number entries on the touch pads 30 followed by touching the start pad 42. Illustratively, if the user wishes to conduct a first cook cycle lasting 1 minute and 20 seconds, he touches pad 21, pads 31, 32 and 40 in sequence, and then start pad 42.

Further illustratively, pad 23 may comprise a keep warm pad, pad 24 may comprise a quick defrost pad, pad 25 may comprise a cook temperature pad, pad 26 may comprise a cook power pad, pad 27 may comprise a minute timer pad, pad 28 may comprise a pause pad, and pad 29 may comprise a clock set pad. Pads 21–29, together comprise the command pads of the control, whereas pads 30 comprise the number pads which are used in conjunction with the selected command obtained by suitable touching of the desired command pad. When the command pads are touched, an associated signal light (not shown) is illuminated, indicating the particular command selected. When the number pads are touched, the display 18 displays the selected numbers in the order the user touches the pads.

Illustratively, to change the minute timer, the user merely touches the minute timer pad 37 and then the number pads corresponding to the desired change time, followed by touching the start pad 42. The new instructions will cancel the old ones. At any time, the minute timer may be cancelled by the user touching the minute timer pad 37 and subsequently the cancel pad 41. The microprocessor 46 is further arranged so as to cancel all cooking instructions by the second touching of the cancel pad 41.

The on/off switch button 43 is disposed between the door 14 and the control panel 17, permitting the user to manually set the switch in the off position when the door 14 is open so that the clock and minute timer will function but the quick defrost and cook cycles of the oven are prevented from actuation, thus serving as a safety device relative to young children and the like.

Upon completion of a selected cooking operation, the control causes a beeping to indicate the completion of the countdown. The beeping may be stopped by the user opening the oven door or touching the cancel pad, thereby returning the display 18 to show the time of day.

Whenever it is desired to change the cooking time during the running of the cycle, or to add another cooking cycle, the user merely touches the cook cycle pad 21 pr 22, then touches the number pads to set the desired time, followed by touching the start pad 42. The microprocessor 46 then causes the new cook cycle to be added to the program or the cook cycle to continue for the newly selected time.

During any cooking cycle, unless the cook power was programmed to be less than full power, it will operate for the prescribed time at full power. If it is desired to change the power output of the microwave energy generator 16 during the cooking cycle, the user merely touches the selected cook cycle pad 31 or 32, the desired touch number pads to establish the cooking time, the cook power pad 26 causing the cook power signal light to be illuminated and the display 18 to show two zeroes, followed by touching a desired number pad 31–39 to select the desired percentage of full power. Illustratively, where it is desired to cook at 90% of full power, the user touches the number pad 39. The cook cycle again is initiated at the lower power by the final touching of the start pad 42, as discussed above. In this mode, the display 18 counts down the time to show how much cooking time is left in the cycle, but for 2 out of every 10 seconds, the display shows the cook power selected. Here again, if it is desired to change the cook power after the cycle is initiated, the user merely touches the cook power pad 26 once, then touches the number pads corresponding to the new desired cook power, followed by retouching of the start pad 42. Should the user wish to go to full power from a previous lower selected power, he need merely touch the cook power pad 26 a second time, followed by touching the start pad 42 without touching any of the number pads, whereupon a full power cook cycle is established.

When it is desired to defrost frozen food in the oven cavity 12, the user places the frozen food in the oven cavity, touches the quick defrost pad 24 followed by touching the number pads to obtain the desired defrosting time and initiates the defrosting cycle by touching the start pad 42.

The microprocessor is arranged to provide a non-cooking standing time following the quick defrost cycle equal to the defrost cycle time when the cook cycle 1 is preset into the control to follow the quick defrost cycle. To provide a different standing time, the user touches in sequence the quick defrost pad 37, the selected number pads to provide the desired defrost time, the cook cycle 2 pad 22, the number pads for the desired standing time, the cook power pad 26, the 0 pad 40 to establish a zero (0) cook power during the selected standing time, and finally the start pad 42. Thus, upon termination of the quick defrost cycle, the oven will shut off and the display will count down the time for cook cycle 2 at zero (0) cook power.

The user may change the defrost time setting at any time during the quick defrost cycle by touching the quick defrost pad 24, and the new numbers for the desired new defrost time, and the start pad 42. However, upon such resetting of the defrost time, the quick defrost cycle will operate at 20% of full cook power automatically.

To effect a sequential cooking at two different cook powers, the user first touches the cook cycle pad 21, the selected number pads 30 to establish the first cook cycle time, the cook power pad 26 if a cook power less than full power is desired, a number pad 30 for the desired cook power percentage, the cook cycle 2 pad 22, the number pads 30 establishing the desired cooking time for the second cycle, the cook power pad 26, the number pad 30 corresponding to the desired cook power percentage in the event the user wishes to carry out the second cook cycle at less than full power, and finally, the start pad 42. Here again, the user may change the time of either of the preselected cook cycles, the selected cook powers, or add a cook cycle 2 in the event he did not initially establish a cook cycle 2. To do this, the user merely touches the cook cycle pad he wishes to change or add, the numbers for the new time if desired, the cook power pad if it is desired to change or add the cook power input, the number for the new cook power or touch the cook power pad again if high power is desired, followed by the touching of the start pad 42 to complete the changed or additional instructional input.

At times it is desired to permit a pause between the cook cycle 1 and cook cycle 2 operations. To effect this, the user merely touches the pause pad 28 following the input of the desired cooking instructions for the cook cycle 1. The user then touches in the desired cooking instructions for the cook cycle 2 operation, followed by touching the start pad 42 to initiate the two-cycle sequence with the intervening pause.

The pause operation may be added by the user while the oven is operating in cook cycle 1 prior to initiating a cook cycle 2 by touching the pause pad 28 and the start pad 42. This will cause the oven to stop automatically after cook cycle 1 and cook cycle 2 will not start until the start pad 42 is again touched.

In the event a cooking operation is already in the cook cycle 2 mode, the user may obtain a pause by opening the oven door to stop the cooking. Upon closing the door and retouching of the start pad 42, cook cycle 2 will be continued to completion.

To effect a keep warm operation, the user touches the keep warm pad 23 followed by touching of the start pad 42. If the oven is already operating, the user may cause an automatic keep warm cycle following the operational cycle by touching the keep warm and start pads in sequence during the ongoing cycle.

To utilize the temperature probe, the user touches the cook temperature pad 25, followed by touching the desired number pad for the desired final temperature. If the user wishes to cook at reduced power, he touches the cook power pad as discussed above, followed by the touching of the number pad corresponding to the desired cook power percentage desired, followed by a touching of the start pad 42 to initiate the cooking cycle.

The control further permits a delayed start of the cook cycle by the sequence of the user touching the cook cycle pad 21, the number pads 30 corresponding to the length of delay desired, the cook power pad 26, the zero (0) pad 40, the cook cycle 2 pad 22, the necessary pads for touching in the cooking time and cook power for cook cycle 2, and the start pad 42. Thus, during cook cycle 1, the magnetron 16 will be off but the display will count down the set time for initiation of the actual cooking operation under the cook cycle 2 control.

Opening of the oven door 14 during a cooking cycle does not cancel the previously inputted cooking instructions other than the keep warm instruction. To re-establish the keep warm cycle, the user must touch the keep warm pad 23 and the start pad 42 to re-establish that cycle. To cancel the minute timer, the user touches the minute timer pad 37, followed by touching the cancel pad.

To cancel all of the previous instructions, the user merely touches the cancel pad 41 without touching any of the command pads 19. Thus, the control 17,62 provides an improved functioning not heretofore available in the microwave oven art wherein the user may selectively change any of the control parameters during a cooking operation without requiring resetting of all the selected commands and numbers, or alternatively, when desired, cancelling all previously inputted instructions.

As indicated above, the improved functioning of control 62 is effected under the supervisory control of the microcomputer 46. Referring to the simplified subroutine flow diagram of FIG. 3, the functioning of the microcomputer in effecting the improved selective control of the cooking operations by the user is as follows:

As is conventional in microcomputer controlled appliances, the microcomputer includes many subroutines to control the overall functioning of the appliance. The subroutine illustrated in FIG. 3 is but one of those routines, the others being conventionally programmed. Microcomputer 46 is normally in a mode that scans the key pads looking for a user entry and if it receives a valid touch entry from any of the keyboard touch pads, it enters the subroutine illustrated in FIG. 3. Block 63 illustrates the recognition that a valid touch pad entry has been received. The subroutine then continues to decision block 64, which asks whether or not the pad that has been touched is the cancel pad 41. If the pad is the cancel pad 41, all functions except for the clock and minute timer functions are cancelled, as called for in step 65, and the program returns to the key scan mode by returning to block 63 through block 71.

If the answer at decision block 64 is "no", i.e. it was not the cancel instruction that had been entered by the user, the flow continues to decision block 66, which asks whether or not it was a function pad 21–29 that had been touched. If it was a function pad 21–29, this would be the normal first entry in the program cycle. If applicable, the time display mode is exited in blocks 90, 91 and the time reset mode is entered in block 67 if clock set pad 29 was touched. If a pad other than pad 29 was touched, the program continues to the decision block 68, which determines whether or not the oven is running. If the oven is not running, the program continues to the block 69 and clears the contents of the temporary buffer **46*a* and the contents of the function register 46*b* for the given function pad entered. The program then continues to the block 70 and enters the function input mode for the function entered by the touched pad. The function input mode is a separate routine operating various display indicators, opening temporary buffer registers, and assigning values to the various number keys depending upon whether a cooking-by-time or temperature function has been chosen. From block 70, the program continues to block 71** following the function input so as to cause the program to return to the key scan mode awaiting a subsequent valid touch pad input once a touched function pad has been released.

Upon such a subsequent valid touch pad entry, the program again enters into the routine shown in FIG. 3. Upon returning to decision block 66, if the pad touched was not one of the function pads 21–29, the program continues to the decision block 72. As the function pad previously touched placed the routine into the function input mode, as discussed above, the program now moves from the decision block 72 to the decision block 73, which determines whether or not a number pad has been touched. As shown, if a number pad has been touched, the program moves to block 75, wherein the program enters the input mode for numbers. This determines how the numbers will be displayed and enters them into the temporary buffer **46*a* for the given function in proper order as touched. The program then moves to re-enter the pad scan sequence by proceeding to block 71**.

After the numbers corresponding to the selected time, or the selected temperature, are touched, the possible key entries may comprise only another function, another number pad, the cancel pad 41, or the start pad 42. It should be noted that the input mode for numbers 75 is ignored when more than four number pads have been sequentially touched.

If the cancel pad 41 is touched, the program will move to decision block 64 and block 65 to clear all the temporary buffer and register contents except for the clock and minute timer. From block 65, the program then continues to block 71 and, thus, re-enters the pad scan mode.

If a different function pad, however, is touched, such as the cook power pad 36, cook cycle 2 pad 22, or quick defrost pad 34, the program will move through the same sequence previously described.

When the start pad 42 is touched, the program moves from block 63 through block 64 to block 66. As the start pad is not a function pad, the program moves to decision block 72 and then to decision block 73. As the program is then in the input mode for the function selected and it is not a number which has been entered, the program moves to decision block 76 where determination is made as to whether or not the input mode for numbers has been entered. If the input mode for numbers has not been entered, the program moves to exit the function's input mode in block 77 as there is nothing to enter in any of the microcomputer registers. Such a failure to enter the input mode signifies that the function key was entered with no time or temperature or cook power level following it.

If the input mode, however, has been entered, the program continues from decision block 76 to block 78 to enter all of the temporary buffer contents into the function register, whereupon the program exits the function input mode to block 71 so as to then be returned to the pad scan.

Returning to the functioning of the control where a function pad 21–28 was touched and the oven is running as determined by block 68, or the touch pad 29 was touched, the program enters a change program timed response mode through block 79. If the operator enters a valid key pad entry during a preselected period of time, such as 5 seconds, the program moves to block 80 through a decision block 82. If the user does not enter a valid key pad entry within this time, the program exits the function ihput mode through block 71 to pad scan block 71.

Having cleared the temporary buffer contents in block 80, the program continues to block 70 to enter the input mode for the function and then re-enters the pad scan block 71.

The other entries in the changed program mode, as discussed previously, are similarly entered by touching different ones of the touch pads of control 17. The other entries, also cause only the temporary buffer contents to be changed, while the register contents are left in whatever form they were before the new function was entered.

When the user enters appropriate times in conjunction with one or more functions, and the start pad 42 is touched, the program will enter decision block 76, and if it is in the input mode for numbers, the program will enter the temporary buffer contents into the function registers, thereby changing each function register for which a key pad entry was made allowing a cycle to be added or parameters for a given function to be changed.

As indicated above, the control 17,62 further provides a pause function and a keep warm function. The pause function also enters the input mode for numbers in block 70 and enters a stop program in temporary buffer **46*a*. The program of operation is continued by again touching start pad 42 which, in the pause mode, goes through decisional block 74 and block 92 to restart the program of operation before returning to block 71. The keep warm function is selected by function pad 23. Upon a valid entry of the keep warm function, no entry from the number pads 30 is required. Thus, after completing all of the previously established time or temperature cycles, the program advances to the keep warm cycle automatically. The keep warm cycle is pre-programmed for a 5% power level and this cycle is maintained until the user touches the cancel pad 41, opens the door 14, or a maximum of 99 minutes, 99 seconds has elapsed. Thus, the subroutine automatically enters the input mode for numbers in block 70 and enters 99 minutes, 99 seconds into temporary buffer 46*a* for the keep warm function whenever the input mode for the keep warm function is entered. Resultingly, the keep warm function is initiated simply by sequentially touching the keep warm pad and start pad 42**, and is automatically continued until one of the termination inputs as discussed above is effected.

Control 17,62 provides an improved microwave oven control in permitting changing or adding of one or more of the cycle functions or parameters while the microwave oven is operating without effecting the progression of the other cycles or requiring re-programming thereof as has been required in microwave oven controllers of the prior art. The control, however, does provide means for canceling all the previously inputted information to permit facilitated restarting of the entire program when desired.

Further, the program provides for a keep warm cycle requiring only a selection of that function and the touching of the start pad to maintain the food in the oven cavity under low temperature, maintained warm conditions.

The foregoing disclosure of specific embodiments is illustrative of the broad inventive concepts comprehended by the invention.

I claim:

1. In a microwave oven having means defining an oven cavity and heating means for effecting microwave energy heating of matter in said oven cavity, the improvement comprising control means for providing selectively different programs of operation of said heating means, said programs having different cycles of operation therein, and including means for changing the selection of cycles including addition and elimination of subsequent cycles and changing the parameters of any cycles of operation during continued running of a presently running cycle of a selected program.

2. The microwave oven structure of claim 1 wherein said control means includes selectively operable first input elements.

3. The microwave oven structure of claim 1 further including means for selectively cancelling the entire selected program during running thereof.

4. The microwave oven structure of claim 1 wherein at least one of the cycle of operation requires no input of parameters.

5. The microwave oven structure of claim 1 wherein said control means includes a manually operable touch pad input means for use in selecting said cycles.

6. The microwave oven structure of claim 1 wherein one of said cycles comprises a cycle of cooking to a selected temperature.

7. The microwave oven structure of claim 1 wherein one of said cycles comprises a "Keep Warm" cycle effecting said microwave energy heating of matter at a five percent power level.

8. The microwav,e oven structure of claim 1 wherein one of said cycles comprises a cycle of de-energization of the heating means prior to a cycle of further energization thereof.

* * * * *